United States Patent [19]

Max

[11] 4,000,887

[45] Jan. 4, 1977

[54] DEVICE FOR LOW-WARP HARDENING OF ANNULAR SEALING MEMBERS

[75] Inventor: Ruf Max, Obereisesheim, Germany

[73] Assignee: Audi NSU Auto Union Aktiengesellschaft, Neckarsulm, Wurtt, Germany

[22] Filed: May 7, 1976

[21] Appl. No.: 684,009

[30] Foreign Application Priority Data

May 9, 1975 Germany ..... 2520697
Sept. 20, 1975 Germany ..... 7529806

[52] U.S. Cl. ..... 266/274; 269/296
[51] Int. Cl.[2] ..... B23K 19/00
[58] Field of Search ..... 266/117, 119, 120, 130, 266/274; 269/296, 321 CF, 321 W.

[56] References Cited

UNITED STATES PATENTS 3,726,466 4/1973 Vedder et al. ..... 269/321 W

*Primary Examiner*—Gerald A. Dost
*Attorney, Agent, or Firm*—Kane, Dalsimer, Kane, Sullivan and Kurucz

[57] ABSTRACT

A fixture for low-warp hardening of thin-walled annular sealing members of hardenable metallic materials, having a C-shaped cross section and capable of being charged in a tempering furnace or the like. The fixture consists of a plurality of stackable trays having an annular rim on top and, radially within the rim, an annular web to accommodate a sealing member. The height of the web is at least equal to that of the rim and is greater than the depth of the sealing member. The under-side of the next tray is flat in the neighborhood of the web and presses the sealing member down on the web.

3 Claims, 4 Drawing Figures

DEVICE FOR LOW-WARP HARDENING OF ANNULAR SEALING MEMBERS

BACKGROUND OF THE INVENTION

The invention relates to a device for low-warp hardening of thin-walled annular sealing members of hardenable metallic materials, having a C-shaped cross section, and capable of being charged in a tempering furnace or the like.

Sealing members of the kind referred to are employed when, in addition to the necessary elasticity, exacting requirements are imposed on heat stability and insensitivity to pressures. To obtain sealing members having such properties, they must be subjected to special heat treatment after forming. It has now been found that distortion will occur during heat treatment owing to the shape and thin-walled construction of the sealing members. This condition occurs, for example, during heat treatment in air circulation furnaces, protective gas furnaces, or salt baths, owing to uneven heating and the result is unusable parts.

SUMMARY OF THE INVENTION

The object of the invention is to provide a device of the kind initially referred to ensure uniform heat exposure and to negate any warping of the sensitive sealing members.

This object is accomplished, according to the invention, in that the device consists of a plurality of stackable trays having an annular rim on top and, radially within said rim, an annular web serving to accommodate a sealing member. The height of the web is at least equal to that of the rim and greater than the depth of the sealing member. The under-side of the next tray is flat in the neighborhood of the web and holds the sealing member down on the web.

The sealing member is inside the fixture and protected against direct heat exposure. In this manner, uniform heating is obtained. The fixture is heated first and then there is an omnilateral uniform transfer of heat to each member.

Any unilateral, non-uniform heating of the warpable sealing members may thus be avoided. Since each member is held down on the web of the tray below by the next following tray, a uniform distribution of the load over the circumference of the sealing member is obtained and the occurrence of warp upon hardening is avoided. In the stacked fixture package consisting of trays, a plurality of sealing members may be treated at the same time, according to the size of the furnace.

To obtain rapid transfer of heat to the fixture, the trays may have axial openings radially within the web. These openings increase the heat-absorbing surface, and the heating medium is enabled to give off heat in the interior of the fixture as well.

In the case of certain materials of which sealing members are made, it has turned out that upon hardening, while no distortion occurs in the transverse plane, the diameter is occasionally subject to shrinkage, so that dimensional stability cannot always be maintained. To avoid this, the trays of the present invention are made up of an annular slit top part and a bottom part with the bottom part having a flat annular groove on top into which the annular top part fits snugly, and the top part likewise having an annular groove on top in which the annular web is arranged. This web has an L-shaped cross section. One leg is perpendicular to the floor of the annular groove and the other leg is parallel to the floor of the annular groove and is directed radially outward. The diameter of the radially inner wall of the annular groove is approximately equal to the inside diameter, and the outside diameter of the radial leg of the web is approximately equal to the outside diameter of the sealing member less its wall thickness. The height of the web is at least equal to the depth of the annular groove and greater than the height of the sealing member, to ensure that the under side of the bottom part of the next tray will press the member down upon the web.

In this design, where the individual sealing member is imprisoned inside the annular groove of the top part of the fixture, and is borne both by the inside diameter of the wall of the groove and by the outside diameter of the radial leg of the web, and pressed against the web by the next tray, in the first place the sealing member can be protected from direct heat exposure on all sides, and in the second place any deformation of the sealing member can be avoided. Therefore, an omnilateral and uniform transfer of heat takes place from the heating fixture to each sealing member, and no dimensional deviation can occur as a result of the hardening operation. By compressing the slit top part, the sealing member can easily be placed on and taken off the web in the top part. Deformation of the top part because of the slit during the heating process is prevented by the fact that it is inserted in the flat annular groove of the bottom part.

BRIEF DESCRIPTION OF THE DRAWINGS

Two embodiments of the invention are represented by way of example in the drawing, which is described as follows.

DESCRIPTION OF THE PREFERRED EMBODIMENTS

Figure 1:
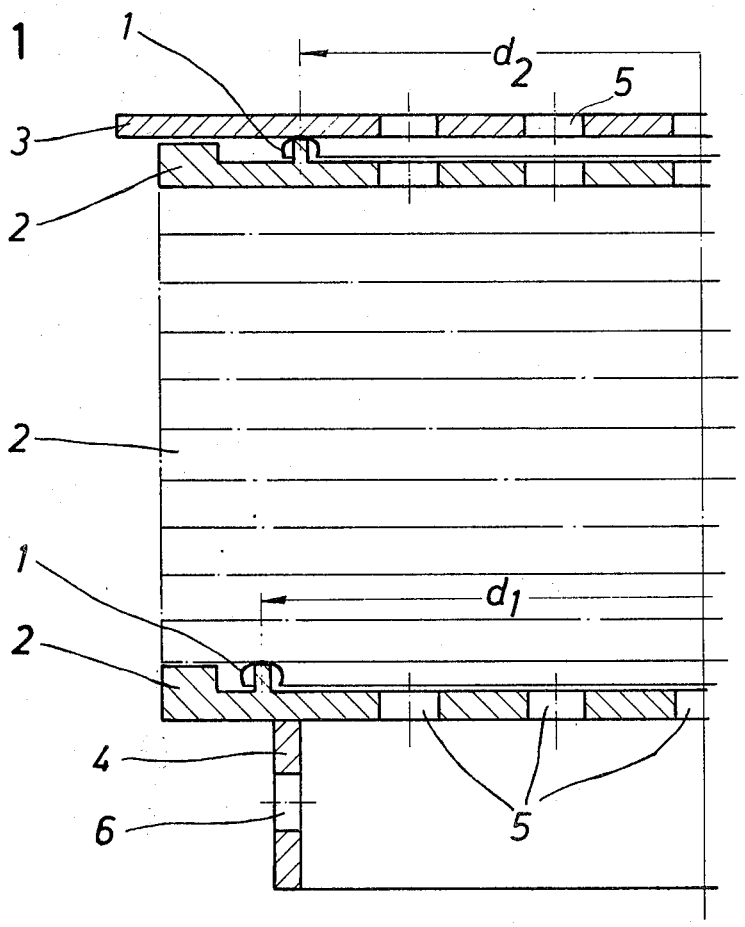
FIG. 1 of the drawing shows a fragmentary, partially sectional view of a fixture consisting of a plurality of trays, in a first embodiment.

Referring first to FIG. 1, in which one half of a fixture according to the invention for low-warp hardening of annular sealing members 1 is represented, the top and bottom segments are shown in section. The fixture consists essentially of a plurality of trays 2, capable of being stacked for heat treatment purposes for example in a tempering furnace, in corresponding number depending on the size of the charge opening. A sealing member 1 is arranged between each two adjacent trays 2. The stacked trays 2 are covered on top by a cover 3 and rest on a tubular base 4 at the bottom. In the trays 2 and cover 3, several axial holes 5 are provided, and apertures 6 in the base 4, so that during the hardening operation the device will be exposed to the heating medium not only on the outside but also on the inside, as is advantageous especially for heat treatment in a salt bath. Through bolts may for example be passed through holes 5 to assemble the package.

Figure 2:
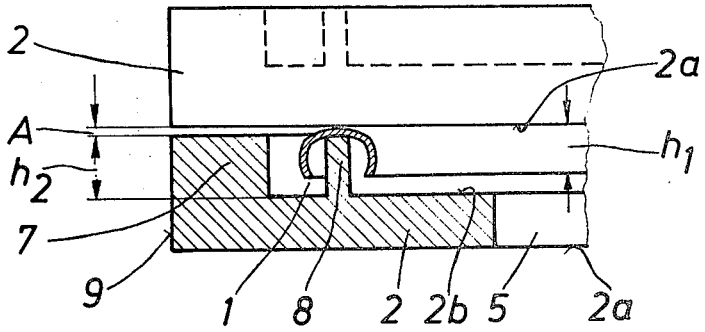
FIG. 2 shows an enlarged section of a portion of the fixture of FIG. 1.

FIG. 2 shows that each tray has a rim 7 along its peripheral edge 9, protecting the sealing member 1 from direct exposure to the heating medium from the outside during treatment. Radially within this rim 7, an annular web 8 is provided, accommodating the sealing member 1. For this purpose, the height $h_2$ of the web 8 is equal to that of the rim 7 but greater than the height $h_1$ of the sealing member 1, so that the member 1 can rest on the web 8 without coming into contact with the top 2b of the tray 2. The flat under side 2a of the next superimposed tray 2 presses the sealing member 1 down on the web 8 under axial load. As shown in FIG. 1, the webs 8 may have different mean diameters $d_1$, $d_2$ to accommodate different sealing rings. With equal height $h_2$ of web 8 and rim 7, of course, a gap A will result between trays 2. Since heating medium can enter through this gap A during treatment, it is desirable for the web 8 to be reduced in height by somewhat less than the thickness of the material of the sealing member 1 from the rim 7, so that the width of the gap A approaches zero. Thus, in any case, there will nevertheless be good contact between the under side 2a and the sealing member 1, so that the latter may be pressed down on web 8 under uniform load.

When heat treating in a tempering furnace, for example an air circulation or inert gas furnace, or in a salt bath, the heat is first taken up by the trays 2 and cover 3 of the fixture. The heat is transferred from the fixture to the sealing members 1, which are closed off from direct heat flux, so that a more uniform heating of the sealing members 1 results. Since the sealing members 1 remain fixed in the fixture throughout the heat treatment, no distortion can occur in the sealing members.

Figure 3:
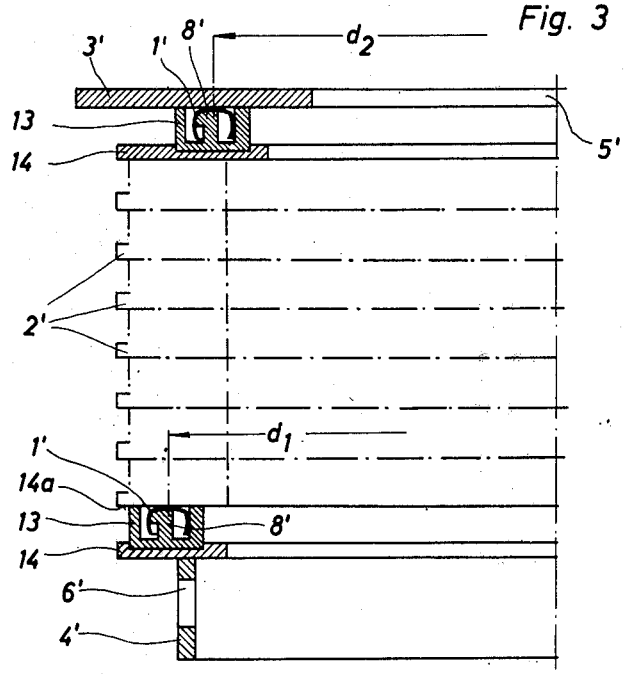
FIG. 3 shows a fragmentary, partially sectional view, similar to FIG. 1, of a second embodiment.
Figure 4:
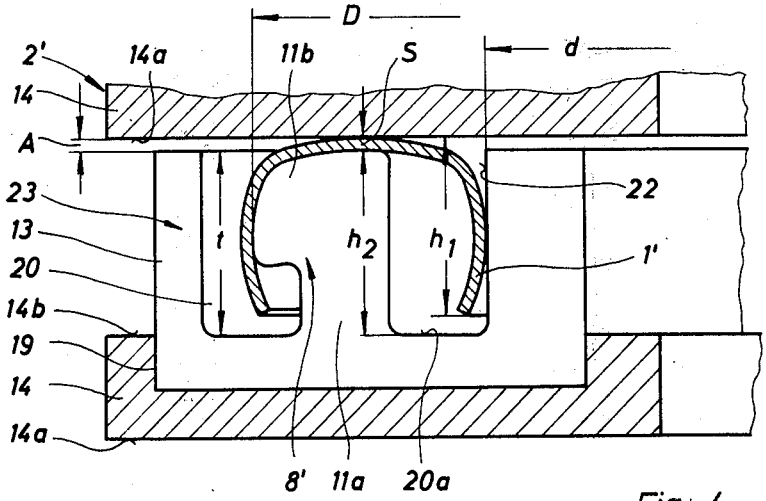
FIG. 4 shows an enlarged section of a portion of the fixture of FIG. 3.

In the second embodiment according to FIGS. 3 and 4, by way of example, the fixture is so constructed that the inside and outside diameters of the sealing member 1' cannot change during the treatment either. For this purpose, the annular trays 2' each consist of an annular slit top part 13 and an annular bottom part 14. Between the top part 13 of one tray 2' and the under side 14a of a neighboring bottom part 14, a sealing member 1' is always arranged. The stacked trays 2' are covered over by a lid 3' and rest on a tubular base 4' at the bottom. Openings 5' and 6' are provided in the cover 3' and in the base 4', so that during the heating operation, the heating medium can reach the trays 2' not only from the outside but also from the inside out, which is an advantage especially for heat treatment in a salt bath.

To accomodate sealing members of various diameters, top parts 13 with webs 8' of varying diameters $d_1$, $d_2$ may be used.

FIG. 4 indicates that on the top 14b of each bottom part 14, a shallow annular groove 19 is provided, into which the annular top part 13 fits snugly. The top part 3 has an annular groove 20 in which the sealing member 1' rests protected from direct exposure to the heating medium during treatment. In the annular groove 20, an annular web 8' is arranged, accommodating the sealing member 1'. The web 8', L-shaped in cross section, has one leg 11a perpendicular to the floor 10a of the annular groove 10, while the other leg 11b is parallel to the floor 10a of the annular groove 10 and directed radially outward, the portion of the web 8' on which the sealing member 1' rests being adapted to the shape of the sealing member 1'. In order for the sealing member 1', supporting the leg 11b by virtue of its shape, to be placed on the web 8' and removed after the hardening operation, the top part 13 is slit at 23, so that it can be compressed before insertion in the annular groove 19 or after removal from it. The slit 23 is represented in FIG. 4 as an unshaded area. To prevent the sealing member 1' from losing its shape and dimensionality during the hardening operation, the inside diameter $d$ of the radially inner wall 22 of the annular groove 20 is equal to the inside diameter of the sealing member 1' and the outside diameter D of the radial leg 11b of the web 8' is equal to the outside diameter of the sealing member 1 less its wall thickness S. Further, the height $h_2$ of web 8' is at least equal to the depth $t$ of annular groove 20 and greater than the height $h_1$ of the sealing member 1', so that the member 1' can rest freely on web 8' without coming into contact with the floor 20a of the annular groove 20. The sealing member 1' is held down on web 8' under axial load by the under side 14a, flat at least in the neighborhood of the web 8', of the bottom part 14 of the next superimposed tray 2'.

If the height $h_2$ of the web 8' and the depth t of the annular groove 20 are equal, a gap A may be left between the top 13 of one tray 2' and the bottom 14a of a neighboring bottom part 14. Since heating medium can penetrate through this gap A during the treatment, it is desirable for the web 8' to be reduced in its height $h_2$ by slightly less than the wall thickness S of the sealing member 1' relative to the depth t of the annular groove 20, so that the size of the gap A approaches zero, as represented in FIG. 3. Thus in any case a satisfactory contact of the bottom part 14a with the sealing member 1' is secured, so that the latter may be pressed down upon the web 8' under uniform load.

As in the first embodiment by way of example, during heat treatment in a tempering furnace, for example an air circulation furnace, an inert gas furnace or a salt bath, the heat is first absorbed by the trays 2' and the cover 3' of the fixture. The heat is transmitted to the sealing member 1', closed off from direct influence of heat, so that a more uniform heating of the sealing members 1' will result. Since the sealing members 1' remain in tension during the entire treatment in the trays 2' of the device, no distortions or changes in diameter can occur at the sealing members 1', thus ensuring proper dimensional stability.

EXAMPLE

A hoop of copper-beryllium alloy, 0.2 mm in thickness, is drawn, in a fixture not shown, into a ring with C-shaped cross section like the ring 1' in FIG. 4. The ring, as yet soft and lacking any spring properties, is placed on the web 8' of a top part 13 after it has been suitably compressed, as made possible by the slit 23. Then the top part 13 is set in the annular groove 19 of a bottom part 14, another bottom part 14 or a cover 3' is placed on the top part 13, the whole is charged in a tempering furnace, heated to 325°–560° C, and kept at that temperature for 1 to 2 hours. Then the ring 1' is allowed to cool to room temperature, which takes about one hour. The heating and subsequent cooling imparts the spring properties to the ring 1'. The placement of the ring 1' on the L-shaped web 8' prevents shrinking of the ring 1' during heating, and hence any change in its inside or outside diameter.

Instead of a copper-beryllium alloy, of course, some other alloy may be used that is at first soft and acquires elasticity only after a tempering process, for example a copper-nickel-aluminum alloy.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. Fixture for low-warp hardening of thin-walled annular sealing members of hardenable metallic materials, having a C-shaped cross section and capable of being charged in a tempering furnace or the like, comprising; the fixture consisting of a plurality of stackable trays having an annular rim on top and, radially within said rim, an annular web to accommodate a sealing member, the height of the web being at least equal to that of the rim and greater than the height of the sealing member, and the under-side of the next tray being flat in the neighborhood of the web and presses the sealing member down on the web.

2. Fixture according to claim 1, characterized in that the trays have axial openings radially within the web.

3. Fixture according to claim 1, characterized in that the trays are made up of an annular slit top part and a bottom part, the bottom part having on its top a flat annular groove into which the annular top part fits snugly, the top part likewise having an annular groove on top in which the annular web is arranged, the web being L-shaped in cross section, one leg of the web being perpendicular and the other leg parallel to the floor of the annular groove and directed radially outward, the diameter of the radially inner wall of the groove being approximately equal to the inside diameter, and the outside diameter of the radial leg of the web being approximately equal to the outside diameter of the sealing member less its wall thickness.

* * * * *